US006736696B2

(12) United States Patent
Peng et al.

(10) Patent No.: US 6,736,696 B2
(45) Date of Patent: May 18, 2004

(54) METHOD OF IMPROVING UNIFORMITY CONTROL ON WAFERS DURING CHEMICAL MECHANICAL POLISHING

(75) Inventors: Cheng-An Peng, Pingtung (TW); Guan-Jiun Yi, Hsinchu (TW)

(73) Assignee: ProMOS Technologies Inc., Hsinchu (TW)

( * ) Notice: Subject to any disclaimer, the term of this patent is extended or adjusted under 35 U.S.C. 154(b) by 92 days.

(21) Appl. No.: 10/134,731

(22) Filed: Apr. 30, 2002

(65) Prior Publication Data

US 2003/0203709 A1 Oct. 30, 2003

(51) Int. Cl.[7] ..... B24B 49/00

(52) U.S. Cl. ..... 451/1; 451/11; 451/41; 451/63; 451/285

(58) Field of Search ..... 451/5, 11, 41, 451/63, 285–289

(56) References Cited

U.S. PATENT DOCUMENTS 6,168,684 B1 * 1/2001 Mitsuhashi et al. .... 156/345.14
6,660,637 B2 * 12/2003 Delage et al. ..... 438/692
2002/0139682 A1 * 10/2002 Basol et al. ..... 205/117

FOREIGN PATENT DOCUMENTS

TW 374047 11/1999

* cited by examiner

*Primary Examiner*—M. Rachuba
(74) *Attorney, Agent, or Firm*—Birch, Stewart, Kolasch & Birch, LLP

(57) ABSTRACT

A method of improving uniformity control in chemical mechanical polishing (CMP). A CMP apparatus is provided with at least a platen, a polishing pad disposed on the platen and at least a polishing carrier installed over the platen. The platen rotates in a first rotating direction, and the polishing carrier is used to press a wafer on the polishing pad and drive the wafer to rotate. First, in a first-CMP step, the polishing carrier rotates in a second rotating direction. Then, in a second-CMP step, the polishing carrier rotates in a third rotating direction different from the second rotating direction.

9 Claims, 3 Drawing Sheets

METHOD OF IMPROVING UNIFORMITY CONTROL ON WAFERS DURING CHEMICAL MECHANICAL POLISHING

BACKGROUND OF THE INVENTION

1. Field of the Invention

The present invention relates to a chemical mechanical polishing (CMP) method and, more particularly, to a method that uses a first-CMP step to form an edge-thicker and center-thinner profile on a wafer and then uses a second-CMP step to compensate for the non-uniformity on the wafer.

2. Description of the Related Art

As IC devices become smaller with highly integrated interconnections, uniformity control in planarization technique becomes much crucial because there are more limitations in subsequent process window, such as depth of focus (DOF) during lithography. Chemical mechanical polishing (CMP), combining chemical reaction and mechanical polishing to planarize the uneven surface of a layer of dielectric or metal on a wafer, benefits controls in subsequent processes, such as deposition, highly-precise exposure and etching stop. FIG. 1 is a schematic diagram showing a polishing apparatus of CMP system according to the prior art. A polishing apparatus 10 comprises a platen 12, a polishing pad 14 attached to the platen 12, and a polishing carrier 16 installed over the platen 12. During CMP, a wafer 18 is placed on the platen 12 and pressed on the polishing pad 14 by the polishing carrier 16. The polishing carrier 16 rotates in a rotating direction A and provides a pressure P to drive the wafer 18. Furthermore, the platen 12 is rotated in a rotating direction B that is the same as the rotating direction A. In addition, slurry 20 is constantly supplied to the platen 12 by a delivery system 22. Therefore, on the platen 12, combining the chemical reaction provided by the slurry 20 and the chemical polishing on the wafer 18, the raised portions on the wafer 18 are removed to achieve planarization.

The uniformity control during CMP depends on the height and density of the raised portions on the predetermined polishing surface, the variation of critical dimension (CD), and the edge-thicker and center-thinner profile of the predetermined polishing surface caused by the useless pattern formed on the edge of the wafer. In order to improve the uniformity control in CMP, the traditional method tunes process parameters, such as pressure forced by the polishing carrier 16, the rotating speed of the polishing carrier 16 and the platen 12, the flowing speed of the slurry 20, the chemical composition of grinding particles in the slurry 20, process temperature and the material of the polishing pad 14. However, the relation between these process parameters is complicated and varied with surrounding circumstances, hence it is difficult to obtain a definite relation because experimental difficulties are encountered and costly measuring facilities are needed. Although various forms used for the polishing carrier and the control of multiple-polishing zones are well developed to improve the uniformity in CMP, they still cannot achieve the expected planarization.

Thus, a CMP process parameter unrelated to the above-mentioned CMP parameters and able to be tuned in various polishing apparatus solving the aforementioned problems is called for.

SUMMARY OF THE INVENTION

The present invention provides a method that uses a first-CMP step to form an edge-thicker and center-thinner profile on a wafer and then uses a second-CMP step to compensate for the non-uniformity on the wafer.

In the method of improving uniformity control in CMP, a CMP apparatus is provided with at least a platen, a polishing pad disposed on the platen and at least a polishing carrier installed over the platen. The platen rotates in a first rotating direction, and the polishing carrier is used to press a wafer on the polishing pad and drive the wafer to rotate. The present invention employs a first-CMP step and a second-CMP step to achieve planarization. The first-CMP step is used to finely modulate the thickness distribution of the depositing layer to decrease the difference in thickness between the edge region and the center region on the wafer. The second-CMP step is used to carry out the main polishing process on the depositing layer to obtain the required planarization and height.

Accordingly, it is a principal object of the invention to provide a CMP process with a first-CMP step and a second-CMP step to compensate for the non-uniformity on the wafer.

It is another object of the invention to provide a CMP method to obtain a required planarization and height on the wafer.

Yet another object of the invention is to provide a CMP method to improve uniformity control on the wafer.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a method of improving the uniformity control in CMP for the application of a depositing layer with the edge-thicker and center thinner profile formed on a wafer. The depositing layer may be formed by high-density plasma chemical vapor deposition (HDPCVE) The present invention employs a first-CMP step and a second-CMP step to achieve planarization. The first-CMP step is used to finely modulate the thickness distribution of the depositing layer to decrease the difference in thickness between the edge region and the center region on the wafer. The second-CMP step is used to carry out the main polishing process on the depositing layer to obtain the required planarization and height.

In one embodiment, the first-CMP step sets the rotating direction of the polishing carrier opposite to that of the platen, and the second-CMP step sets the rotating direction of the polishing carrier the same as that of the platen. In another embodiment, the first-CMP step sets the rotating direction of the polishing carrier the same as that of the platen, and the second-CMP step sets the rotating direction of the polishing carrier opposite to that of the platen. In addition, by modifying the setting programs of the CMP system, the first-CMP step and the second-CMP step can be carried out on the same platen or on two different platens.

[First Embodiment]

Figure 1:
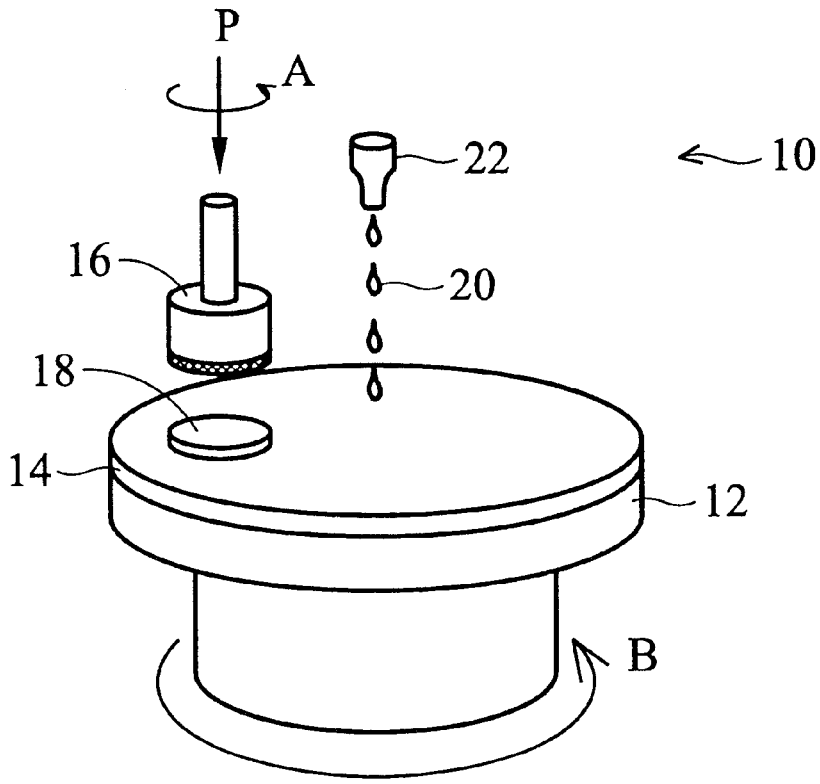
FIG. 1 ( PRIOR ART )
FIG. 1 is a schematic diagram showing a polishing apparatus of CMP system according to the prior art.
Figure 2A:
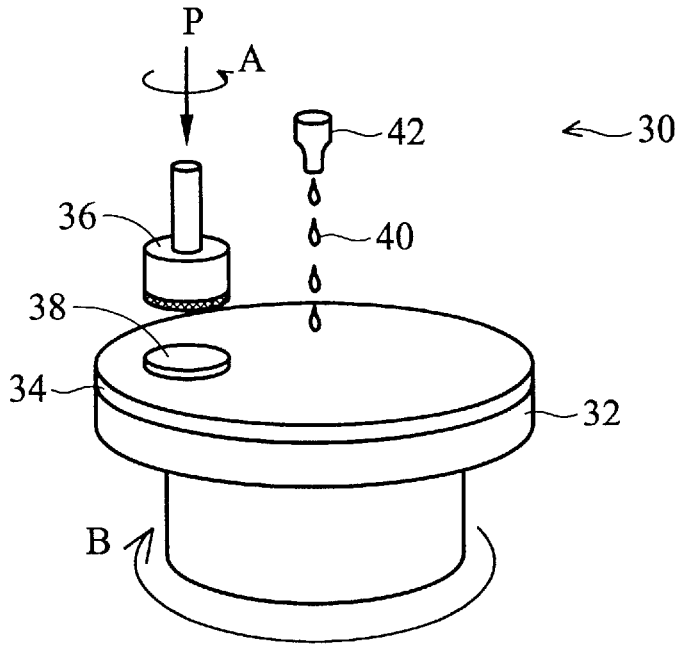
FIGS. 2A and 2B are schematic diagrams showing a polishing apparatus according to the first embodiment of the present invention.
Figure 2B:
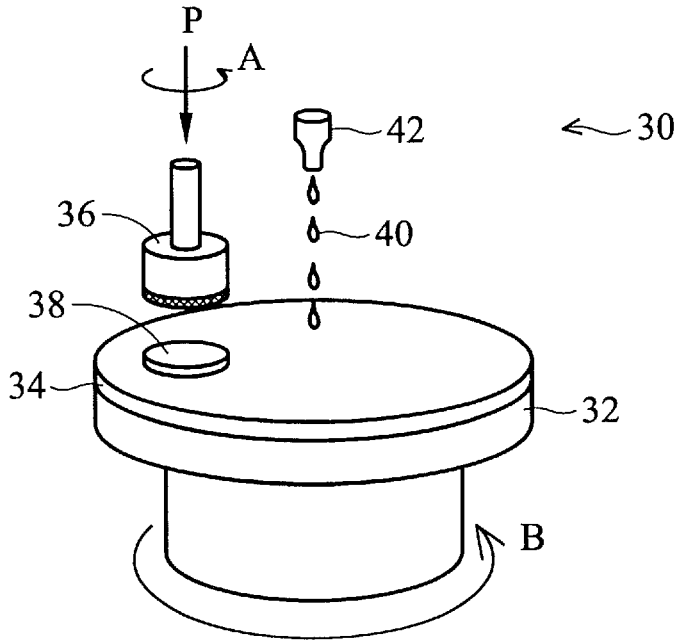

FIGS. 2A and 2B are schematic diagrams showing a polishing apparatus according to the first embodiment of the present invention. A polishing apparatus 30 comprises a platen 32, a polishing pad 34 attached to the platen 32, and a polishing carrier 36 installed over the platen 32. During CMP, a wafer 38 with a depositing layer is placed on the platen 32 and pressed on the polishing pad 34 by the polishing carrier 36. The polishing carrier 36 rotates in a rotating direction A and provides a pressure P to drive the wafer 38, and the platen 32 is rotated in a rotating direction B. In addition, slurry 40 is constantly supplied to the platen 32 by a delivery system 42. Therefore, on the platen 32, combining the chemical reaction provided by the slurry 40 and the chemical polishing on the wafer 38, the raised portions on the wafer 38 are removed to achieve planarization.

As shown in FIG. 2A, in a first-CMP step, the rotating direction A of the polishing carrier 36 is different from the rotating direction B of the platen 32. This provides a faster polishing speed on the edge-thicker region of the wafer 38, and a slower polishing speed on the center-thinner region of the wafer 38. The polishing time and the rotating speed of the polishing carrier 36 can be appropriately adjusted depending on the difference in thickness between the edge region and the center region of the depositing layer on the wafer 38. Therefore, the thickness distribution of a depositing layer can be fine tuned to decrease the difference in thickness between the edge region and the center region on the wafer 38.

As shown in FIG. 2B, in a second-CMP step, the rotating direction A of the polishing carrier 36 is the same as the rotating direction B of the platen 32. This provides a slower polishing speed on the edge-thicker region of the wafer 38, and a faster polishing speed on the thinner—thinner region of the wafer 38. The polishing time and the rotating speed of the polishing carrier 36 can be appropriately adjusted depending on a predetermined thickness of the depositing layer remaining on the wafer 38 to reach the required planarization and height.

[Second Embodiment]

In the second embodiment of the present invention, the first-CMP step sets the rotating direction A of the polishing carrier 36 the same as the rotating direction B of the platen 32 (as shown in FIG. 2B). Also, the first-CMP step appropriately adjusts the polishing time and the rotating speed of the polishing carrier 36 depending on the result obtained by deducting the thickness difference between the edge region and the center region from the predetermined thickness of the depositing layer. Next, the second-CMP step sets the rotating direction A of the polishing carrier 36 different from the rotating direction B of the platen 32 (as shown in FIG. 2A) Also, the second-CMP step appropriately adjusts the polishing time and the rotating speed of the polishing carrier 36 depending on the difference in thickness between the edge region and the center region on the wafer 38 till the depositing layer reaches the required planarization and height.

[Third Embodiment]

Figure 3:
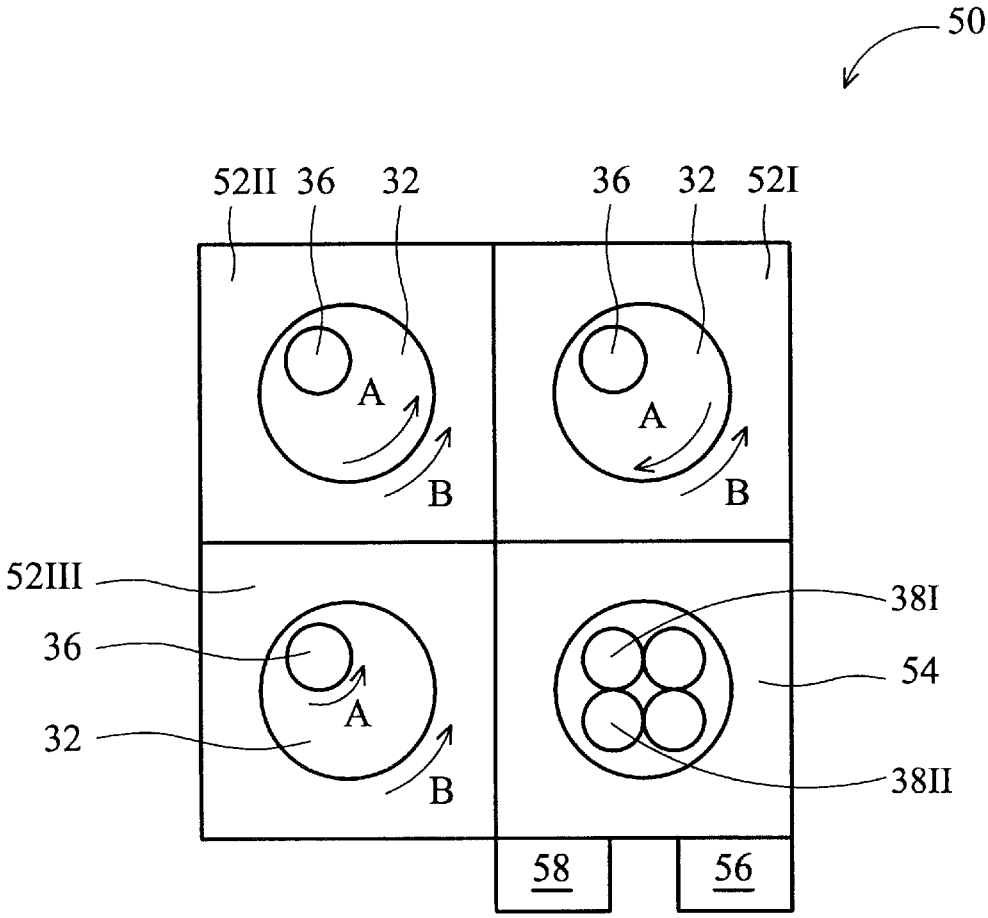
FIG. 3 is a top view showing a CMP system according to the third embodiment of the present invention.

By modifying the first embodiment that performs the two CMP steps on the same platen, the third embodiment performs the first-CMP step and the second-CMP step on different platens. FIG. 3 is a top view showing a CMP system according to the third embodiment of the present invention. A CMP system 50 comprises a plurality of polishing modules 52, a chip-conveying module 54, a chip-loading module 56 and a chip-unloading module 58. Each polishing module 52 comprises the above-described facilities, such as platen 32, polishing pad 34, polishing carrier 36, and slurry 40. By modifying the setting programs of the CMP system 50, the first polishing module 52I is used to perform a first-CMP step, in which the rotating direction A is different from the rotating direction B, and the polishing time and rotating speed depends on the difference in thickness between the edge region and the center region of the depositing layer on the wafer 38. The second polishing module 52II or the third polishing module 52III is used to perform a second-CMP step, in which the rotating direction A is the same as the rotating direction B, and the polishing time and rotating speed depends on the predetermined thickness of the depositing layer remaining on the wafer 38 to reach the required planarization and height. Generally, the polishing time of the first-CMP step is shorter than that of the second-CMP step.

During CMP, a first predetermined wafer 38I is conveyed to the first polishing module 52I to perform the first-CMP step to reduce the difference in thickness between the edge region and the center region of the depositing layer. Then, the first predetermined wafer 38I is conveyed to the second polishing module 52II to perform the second-CMP step to obtain the required planarization and height of the depositing layer. Since the first-CMP step and the second-CMP step are performed on different polishing modules 52I and 52II, the CMP efficiency and yield are increased. Also, in each polishing module 52, the rotating direction A of the polishing carrier 36 cannot be periodically changed, thus the active life of the polishing carrier 36 is prolonged.

In addition, by modifying the second embodiment that performs the two CMP steps on the same platen, the third embodiment performs the first-CMP step and the second-CMP step on different platens. During CMP, the second polishing module 52II is used to perform the first-CMP step in which the rotating direction A of the polishing carrier 36 is the same as the rotating direction B of the platen 32. Then, the first polishing module 51I or the third polishing module 52III is used to perform the second-CMP step, in which the rotating direction A of the polishing carrier 36 is different from the rotating direction B of the platen 32.

It is to be understood that the present invention is not limited to the embodiments described above, but encompasses any and all embodiments within the scope of the following claims.

What is claimed is:

1. A method of improving uniformity control in chemical mechanical polishing (CMP), comprising steps of:

providing a CMP apparatus comprising at least a platen, a polishing pad disposed on the platen and at least a polishing carrier installed over the platen, wherein the platen rotates in a first rotating direction, and the polishing carrier is used to press a wafer on the polishing pad and drive the wafer to rotate;

performing a first-CMP step in which the polishing carrier rotates in a second rotating direction; and performing a second-CMP step in which the polishing carrier rotates in a third rotating direction different from the second rotating direction.

2. The method according to claim 1, wherein the first rotating direction is different from the second rotating direction.

3. The method according to claim 2, wherein in the first-CMP step, the polishing time and rotating speed of the polishing carrier depend on the difference in thickness between the edge region and the center region of the wafer.

4. The method according to claim 2, wherein in the second-CMP step, the polishing time and rotating speed of the polishing carrier depend on a predetermined thickness remaining on the wafer.

5. The method according to claim 1, wherein the first rotating direction is the same as the second rotating direction.

6. The method according to claim 5, wherein in the first-CMP step, the polishing time and rotating speed of the polishing carrier depend on the result obtained by deducting the thickness difference between the edge region and the center region on the wafer from a predetermined thickness remaining on the wafer.

7. The method according to claim 5, wherein in the second-CMP step, the polishing time and rotating speed of the polishing carrier depend on the difference in thickness between the edge region and the center region of the wafer.

8. The method according to claim 1, wherein in the first-CMP step and the second-CMP step are performed on the same platen.

9. The method according to claim 1, wherein in the first-CMP step and the second-CMP step are performed on different platens.

* * * * *